US005730310A

United States Patent [19]

Yoshihara

[11] Patent Number: 5,730,310

[45] Date of Patent: Mar. 24, 1998

[54] LID OPENING MECHANISM SYSTEM

[76] Inventor: Hiroshi Yoshihara, 10-16, Kamiigusa 2-chome, Suginami-ku, Tokyo 167, Japan

[21] Appl. No.: 379,500

[22] PCT Filed: Feb. 4, 1994

[86] PCT No.: PCT/JP94/00167

§ 371 Date: Jan. 31, 1995

§ 102(e) Date: Jan. 31, 1995

[87] PCT Pub. No.: WO95/09777

PCT Pub. Date: Apr. 13, 1995

[30] Foreign Application Priority Data

| | | | |
|---|---|---|---|
| Oct. 1, 1993 | [JP] | Japan | 5-267801 |
| Nov. 9, 1993 | [JP] | Japan | 5-302203 |

[51] Int. Cl.[6] ..... B65D 43/06

[52] U.S. Cl. ..... 220/335; 16/225; 220/283; 220/337; 220/339

[58] Field of Search ..... 16/227, 225; 222/517, 222/556; 220/335, 337, 339, 281, 283, 324, 326

[56] References Cited

U.S. PATENT DOCUMENTS

| | | | |
|---|---|---|---|
| 3,282,462 | 11/1966 | Box | 220/DIG. 15 X |
| 3,348,724 | 10/1967 | Rosso | 220/281 |
| 3,512,698 | 5/1970 | Kapustka | 220/339 X |
| 3,628,215 | 12/1971 | Everburg | 220/339 X |
| 3,629,901 | 12/1971 | Wolf et al. | 220/339 X |
| 3,760,972 | 9/1973 | McKirnan | 220/281 X |
| 3,968,880 | 7/1976 | Ostrowsky | 220/339 X |
| 4,095,712 | 6/1978 | Perrella | 220/281 X |
| 4,133,449 | 1/1979 | Ostrowsky | 220/283 X |
| 4,403,712 | 9/1983 | Wiesinger | 220/339 X |
| 4,607,768 | 8/1986 | Taber et al. | 222/556 X |
| 5,273,177 | 12/1993 | Campbell | 16/227 X |

FOREIGN PATENT DOCUMENTS

| | | | |
|---|---|---|---|
| 406127 | 4/1968 | Australia | 16/225 |
| 104453 | 10/1966 | Denmark | 16/225 |
| 49-26033 | 7/1974 | Japan . | |
| 55-6357 | 2/1980 | Japan . | |
| 55-151210 | 10/1980 | Japan . | |
| 59-152139 | 8/1984 | Japan . | |
| 61-113243 | 7/1986 | Japan . | |
| 245266 | 3/1990 | Japan . | |
| 43974 | 2/1992 | Japan . | |
| 430120 | 7/1992 | Japan . | |
| 440566 | 9/1992 | Japan . | |
| 1056999 | 2/1967 | United Kingdom | 16/225 |

*Primary Examiner*—Allan N. Shoap
*Assistant Examiner*—Robin A. Hylton
*Attorney, Agent, or Firm*—Jordan and Hamburg

[57] ABSTRACT

A lid opening mechanism in which a lid can be opened and closed on a hinge with respect to an associated body 1, includes two slits formed in an arbitrary part of the hinge 3 so as to extend along the opening/closing dimension of the hinge 3 and spaced apart from each other so as to define therebetween a pushing operation section that is large enough to be pushed with a finger, wherein the slits extend across hinge grooves of the hinge, with at least one end of each slit reaching the body or the lid, whereby it is possible for the lid of various cases, containers, etc. or the opening member of various apparatuses to be opened to a desired angle with one hand and by a one-push operation.

20 Claims, 12 Drawing Sheets

LID OPENING MECHANISM SYSTEM

TECHNICAL FIELD

This invention relates to a lid opening mechanism which enables the lid or opening member of various cases or apparatuses to be opened with one hand and which is applicable not only to various cases or containers made of plastic or metal but also to paper boxes for packing cigarettes, caramels, etc.

Further, this invention relates to a lid opening mechanism applicable to cases formed in one piece of plastic, etc., such as spectacle cases, cosmetic compacts, and cases for various storage media like floppy disks, or to detergent-container caps or the like.

Furthermore, the mechanism of this invention can also be utilized as an opening mechanism or opening member in various articles of furniture or various machines or instruments for office or industrial uses.

BACKGROUND OF THE INVENTION

There are various cases or containers composed of a body and lid formed in one piece of plastic material like polyethylene. There are also cases whose lid and body are respectively provided with male and female hooks that can be engaged with each other to close the lid.

To enable such cases or containers to be opened with one hand while being held in the same hand, a method has been adopted according to which a strong push is given to the body-side hook from outside with the thumb, etc. so as to distort the hook, thereby releasing the lid-side hook from the engagement.

A problem of this conventional method is that the lid cannot be opened unless the finger is strong enough. Nevertheless, this type of opening mechanism is widely adopted in spectacle cases, cases for writing implement, toys, food containers, etc., which is rather inconvenient for elderly, female, or very young users.

Furthermore, although it is true that the engagement between the body-side and lid-side hooks can be cancelled by strongly pushing the body-side hook, it is not possible to open the lid wide without using both hands or providing a spring mechanism or the like in the hinge section, etc. (See, for example, Japanese Utility Model Laid-Open No. 55-151210 and Japanese Utility Model Publication No. 4-30120).

Some cosmetic compacts, etc. can be opened or closed by a slight push of a finger while being held with one hand (See, for example, Japanese Utility Model Laid-Open No. 61-113243 and Japanese Utility Model Publications No. 4-3974 and 4-40566). However, the opening/closing mechanism of such cases requires hooks and hook releasing members, and further, pins, springs, etc. for the hinge section. This necessitates equipment, technique and processes for machining as well as molds for producing such parts, which inevitably leads to a high production cost, with the result that the range of uses for this opening mechanism is restricted to certain fields, for example, luxury goods.

Some of the caps of containers for bath agents, shampoos, etc. have slits similar to those of the present invention (See, for example, Japanese Utility Model Laid-Open No. 2-45266). However, these slits in such caps are completely different from those of the present invention in terms of purpose, structure, operating method and effect. The section which is separated from the hinge by these slits serves as a spring member when the lid is opened or closed. When the lid is opened, this separated section protrudes outwardly from the cap. When the lid is closed, the hinge section protrudes sharp to the exterior. That is, the structure is completely different from that of the present invention, in which a pushing operating section is pushed inwardly.

Structures having a lid or opening member which can be opened are generally adopted in industrial apparatuses, office equipment, household goods, etc., or in various types of bags, cases or the like. However, due to their complicated structure, etc., they are made up of a large number of parts which are to be prepared and assembled through a number of processes, resulting in a lot of time being required for their manufacture. Among them is a home TV remote control having a battery accommodating section, whose lid is rather difficult to open. Moreover, when opened, the lid is detached from the remote control, so that the lid may get lost.

DISCLOSURE OF THE INVENTION

To open cases, containers, appliances, etc. with one hand, it is not only desirable that the engagement between the lid and body allow cancelling with one hand, but that the lid be capable of being opened to a desired angle with the same hand. At the same time, it is desirable that the number of parts, man-hours, etc. needed for the production of the opening mechanism be as small as possible to facilitate the production.

The present invention provides a lid opening mechanism of the type in which a lid can be opened and closed on a hinge with respect to an associated body constituting a stationary counterpart for the lid, wherein two slits are formed which extend from an arbitrary position on the body up to the hinge and which are spaced apart from each other so as to define therebetween a pushing operation section which is wide enough to be pushed with a finger.

The slits may extend across hinge grooves of the hinge, with one end of each slot reaching at least either the body or the lid.

The slits may extend across hinge grooves of the hinge, with ends thereof reaching the lid. At the same time, a bending line is formed in that part of the push operation section which is on the lid side, and bending sections extending from the lid-side ends of the slides are formed in the right and left side portions of the lid, whereby the lid can be opened both from above the lid and from the hinge side.

In the structure, when the pushing operation section is pushed in, it is deformed toward the inner side of the case since the lid is connected to the body by the hinge and an end portion of the pushing operation section is connected to the body, whereby the section where the body and the lid are joined together is shortened, and the lid is opened by the resulting tension.

In the structure, pushing-in of the pushing operation section results in the length of the diagonal line connecting the joint sections between the body and the lid being enlarged since the two sides of the pushing operating section are flattened due to rotatable connection of the body and lid through the hinge, and the lid is opened by the resulting pushing force.

In the structure, the lid is opened in the following two manners: first, when that part of the pushing operation section which is on the upper side of the lid is pushed from above, it is bent toward the interior of the container. This causes the lid to open upwards around bending lines and support sections in the right and left side portions of the lid, an end portion of the pushing operation section being connected to the lid. When a side surface of the pushing operation section is pressed, the bending line in the upper part of the pushing operation section is bent toward the interior of the container to a degree corresponding to the push-in amount, thereby causing the lid to open upwards around the bending lines in the right and left side portions of the lid. When further pushing force is applied, the entire lid is opened wide around the joint section on the body, that is, the hinge portion.

The present invention is not only applicable to the lid opening mechanism for cases or containers formed by assembling separate parts or cases or containers formed in one piece, but can be used as an opening mechanism component in machines or instruments. For the sake of convenience, in the following description, the terms body and lid are used for cases or containers formed by assembly, and the terms body portion and lid portion are used for cases or containers formed in one piece. However, the terms body and body portions mean substantially the same thing, and so do the terms lid and lid portion. Further, in describing apparatuses, what corresponds to the lid may be referred to as an opening member, and what corresponds to the body as a stationary section. However, the terms lid and opening member mean substantially the same thing, and so do the terms body and stationary section.

BRIEF DESCRIPTION OF THE DRAWINGS

FIG. 37 is a perspective view showing an embodiment of the opening mechanism of the present invention as applied to the cap of a bottle or the like;

BEST MODE FOR CARRYING OUT THE INVENTION

Figure 1:
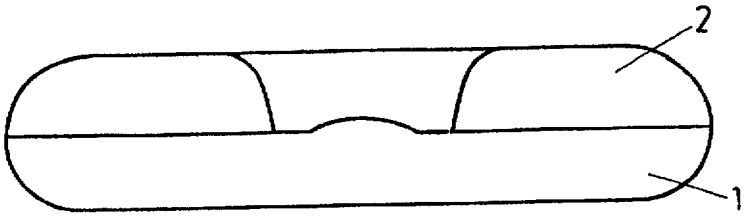
FIG. 1 is a front view showing an embodiment of the lid opening mechanism of the present invention as applied to a spectacle case.
Figure 2:
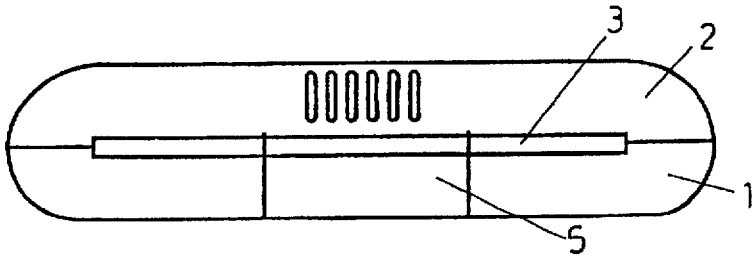
FIG. 2 is a rear view of the case.
Figure 3:
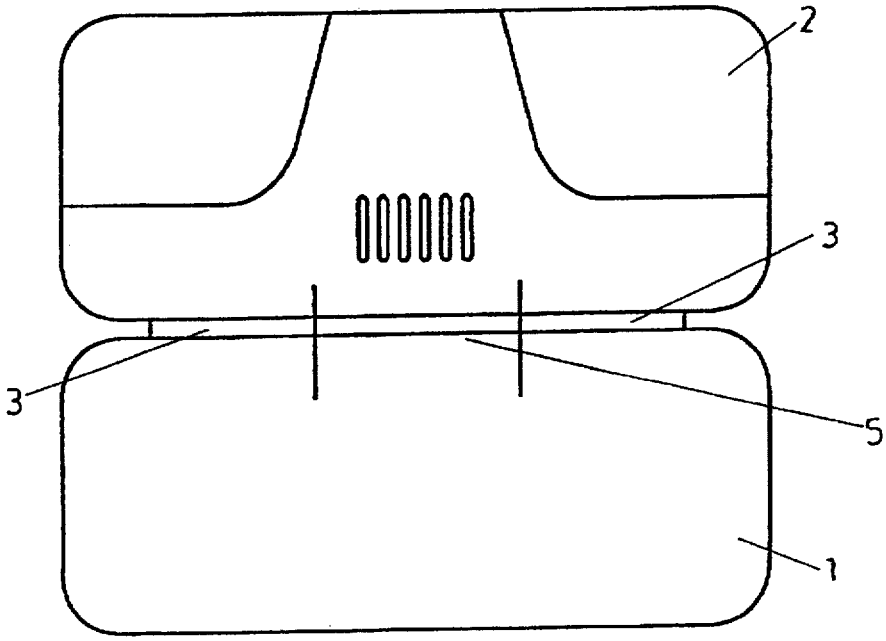
FIG. 3 is a bottom view of the case opened by 180°.
Figure 5:
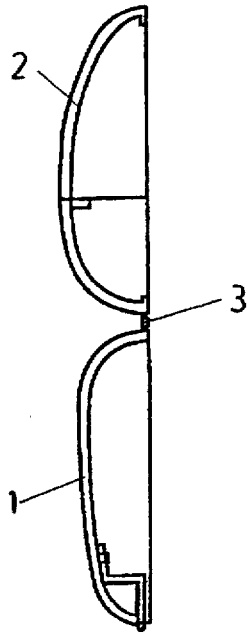
FIG. 5 is a sectional view taken along a line A—A of FIG. 4.
Figure 4:
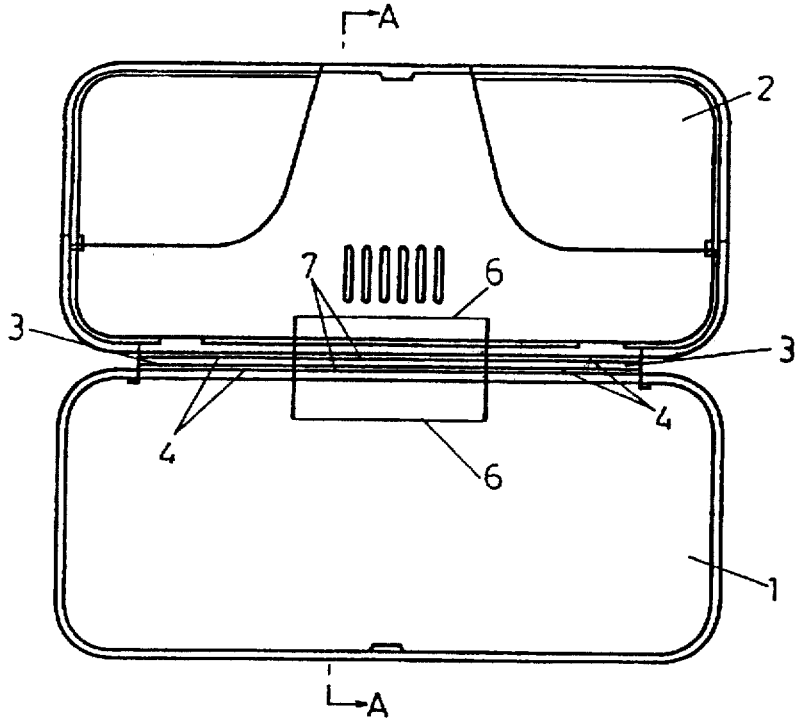
FIG. 4 is a plan view of the case opened by 180°.
Figure 6:
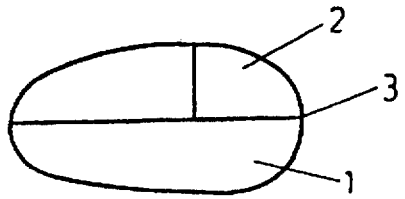
FIG. 6 is a side view of the case.
Figure 7:
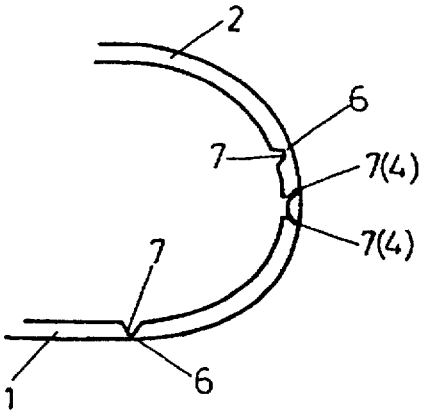
FIG. 7 is an enlarged sectional view showing the hinge portion.

Embodiments of the lid opening mechanism of the present invention will now be described with reference to the drawings.

First Embodiment

First, a lid opening mechanism will be described with reference to the spectacle case shown in FIGS. 1 through 8.

Numeral 1 indicates a spectacle case body, and numeral 2 indicates a lid which is connected with the body 1 by a hinge 3 in such a way that it can be opened and closed. Numeral 4 indicates grooves provided on the inner side of the hinge 3. In the example shown, two hinge grooves 4 make the hinge 3 rotatable.

Numeral 5 indicates a pushing operation section which is provided in the central portion of the hinge 3 as a separate member from the hinge 3. End portions 6 of the pushing operation section 5 are respectively connected to the body 1 and the lid 2. The pushing operation section 5 is wide enough to be pushed with a finger and has a curved sectional configuration similar to that of the hinge 3. Formed on the inner side of the pushing operation section 5 are bending grooves 7 similar to the hinge grooves 4. The end portions 6 also have bending grooves 7.

When the lid 2 is in the closed state, the distance between the end portions 6 of the pushing operation section 5 is at a minimum. It is not always necessary for the pushing operation section 5 to have a configuration similar to that of the hinge 3. For example, it may have a V-shaped configuration. Further, it is not always necessary for the bending grooves 7 to be arranged at the same positions as the hinge grooves 4. It is possible to provide only one bending groove 7 or a plurality of them. For easy pushing operation, it is desirable that the angle of the pushing operation section 5 to be larger than 90° (i.e., an obtuse angle) when seen from the interior of the case.

Figure 22:
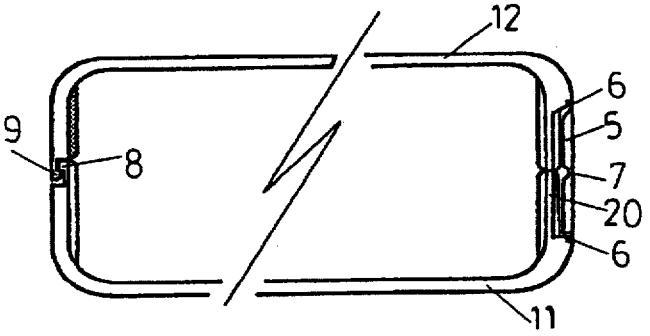
FIG. 22 is an enlarged sectional view of the case.

Numeral 8 indicates a male hook formed on the body 1, and numeral 9 indicates a female hook formed on the lid 2. The male and female hooks 8 and 9 are engaged with each other when the case is closed. FIG. 22 shows the configuration of the male and female hooks 8 and 9 respectively.

While the body 1, lid 2, hinge 3, pushing operation section 5, male hook 8, female hook 9, etc. can be integrally molded from synthetic resin, this is not always necessary. The requisite opening mechanism may also be prepared as a component, which is attached to associated case or the like by welding, fusion, fitting, screwing, gluing, etc. depending upon the materials, manufacturing process, etc. Further, the pushing operation section 5, at least, is formed beforehand of a deformable object. Materials having a high level of bending durability and elasticity, such as sheets of soft resins like PP or nylons, or long-fiber paper materials, are effective.

Next, the operation of opening the lid 2 of this embodiment will be described.

First, when the lid 2 is in the state closed on the body 1 (the state shown in FIGS. 6 and 7), the pushing operation section 5 exhibits the same configuration as the hinge 3.

In this condition, when the pushing operation section 5 is pushed toward the interior of the case, the pushing operation section 5 is deformed so as to be bent where the bending grooves 7 are formed. As a result of this deformation, the distance between that end portion 6 of the pushing operation section 5 which is on the body 1 and that end portion 6 which is on the lid 2 increases, with the result that the lid-side end portion 6 moves upwards from the position shown in FIG. 7 to the position shown in FIG. 8. Thus it will be seen that such pushing operation results in increasing the diagonal distance between the ends 6 of the pushing operation section as can be seen by comparing FIGS. 7 and 8.

Figure 8:
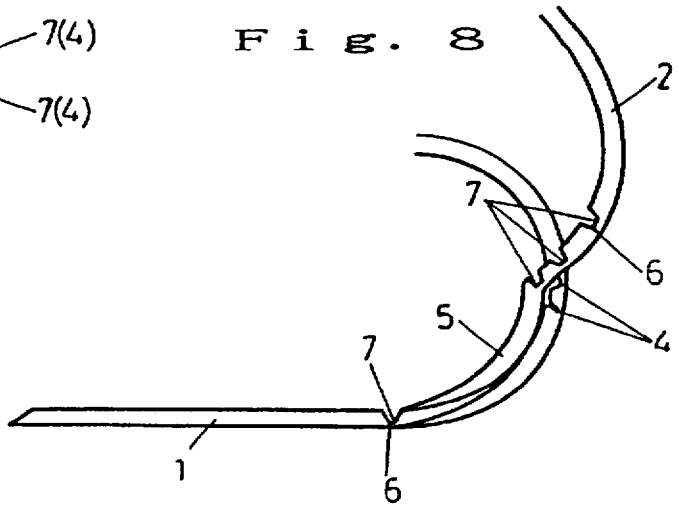
FIG. 8 is an enlarged sectional view showing the opening mechanism of the hinge portion of the case shown in FIG. 7.
Figure 9:
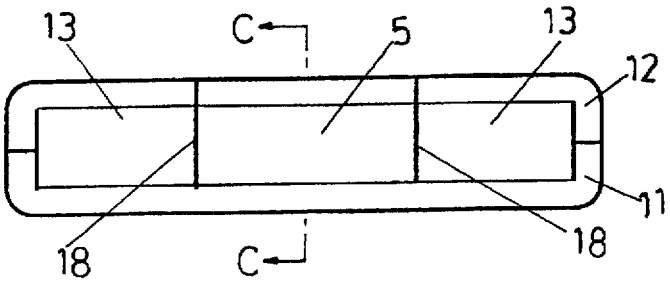
FIG. 9 is a front view showing an embodiment of the present invention as applied to a cassette case capable of accommodating two cassettes.
Figure 10:
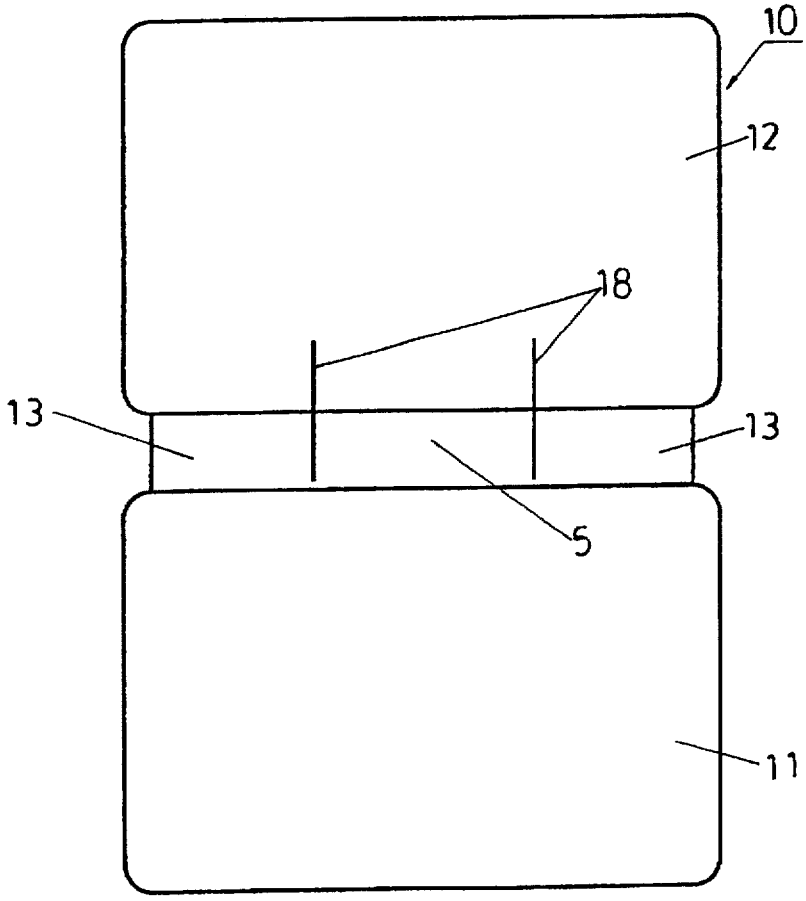
FIG. 10 is a bottom view showing the case opened by 180°.
Figure 11:
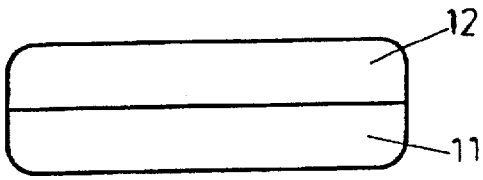
FIG. 11 is a side view of the case.
Figure 12:
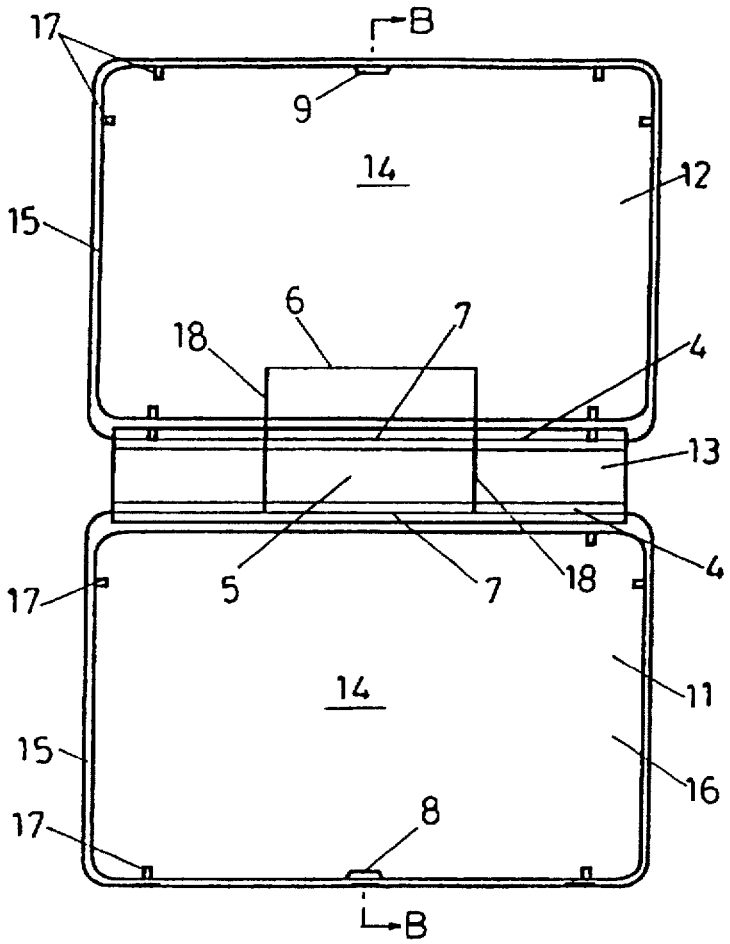
FIG. 12 is a plan view of the case opened by 180°.
Figure 15:
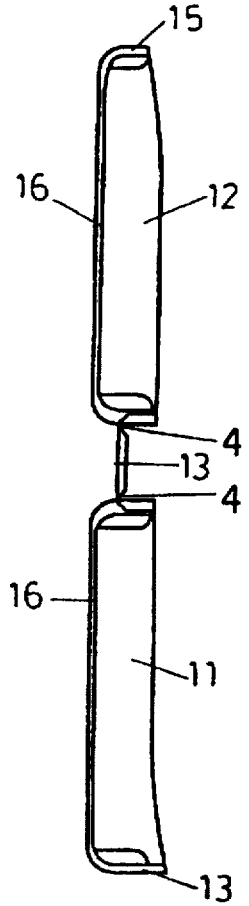
FIG. 15 is a sectional view taken along a line B—B of FIG. 12.
Figure 16:
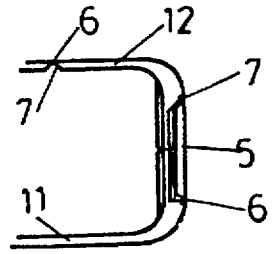
FIG. 16 is an enlarged sectional view of the hinge portion of the case.
Figure 13:
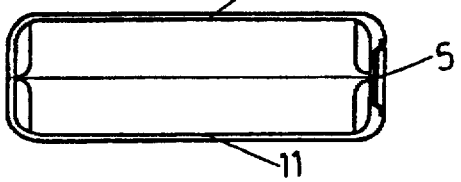
FIG. 13 is a sectional view taken along a line C—C of FIG. 9.

When the lid-side end portion 6 moves upwards (as seen in the drawings), the lid 2 itself rotates on the hinge 3, whereby the lid 2 is opened as shown in FIG. 8. By adjusting the amount by which the pushing operation section 5 is pushed in, it is possible to adjust the opening angle of the lid 2.

Second Embodiment

Next, an example of the lid opening mechanism, in which the lid opening mechanism is integrally formed with the associated case, etc., will be described with reference to the cassette tape case capable of accommodating two cassettes which is shown in FIGS. 9 through 17. By appropriately changing its size and configuration, the case can also be used as cases for CD, DCC, MD, etc.

Numeral 10 indicates a cassette tape case body capable of accommodating two cassettes which is integrally molded from synthetic resin and which comprises two thin cases 11 and 12 that are rotatably linked together by a hinge portion 13. Numeral 14 indicates accommodating sections of the thin cases 11 and 12. The accommodating sections 14 are formed by outer peripheral sections 15 and bottom sections 16. The accommodating sections 14 have substantially the same configuration as the cassette tapes, and the outer peripheral sections 15 have substantially the same height (thickness) as the cassette tapes. Numeral 17 indicates cassette tape locking sections arranged in the outer peripheral sections 15. In the following description, the thin case 11 will be referred to as the body portion 11 and the thin case 12 as the lid portion 12.

On the inner side of the case, the hinge portion 13 has hinge grooves 4 which are respectively formed in those sections of the hinge portion where it is joined to the body portion 11 and the lid portion 12. When the body portion 11 and the lid portion 12 are rotated so as to be bent 90° at the hinge grooves 4 of the hinge portion 13, a box-like space is obtained which is surrounded by the bottom sections 16 and the outer peripheral sections 15 of the body portion 11 and the lid portion 12 and the hinge section 13.

Numeral 5 indicates a pushing operation section which is formed by two slits 18 which are provided in the central portion of the hinge section 13 so as to be spaced from each other by a distance to define a section which is large enough to be pushed with a finger, the slits 18 extending along the opening/closing dimension of the lid portion 12. The slits 18 extend across the hinge grooves 4, with one end of each slit 18 reaching the lid portion 12. The other end of each slit 18 reaches the hinge groove 4 in the body portion 11. Since the pushing operation section 5 is formed by dividing the hinge section 3 by the slits 18, the pushing operation section 5 has bending grooves 7 which are similar to the hinge grooves 4 and situated at positions corresponding thereto.

The slits 18 may be formed by an after-processing posterior to the molding of the case, or formed integrally with the case when the latter is molded. Further, it is not always necessary for the bending grooves 7 to be positions corresponding to the hinge grooves 4. It is also possible for the bending grooves 7 to be provided in an arbitrary number.

Numeral 8 indicates a male hook formed on the body portion 11, and numeral 9 indicates a female hook formed on the lid portion 12. The male and female hooks 8 and 9 are engaged with each other when the lid portion 12 is closed. The male and female hooks 8 and 9 are also formed by one piece molding. Further, when both the male and female hooks 8 and 9 are formed so as to be directed toward the interior of the case, no portion of the hooks protrudes beyond the contour of the case, thereby imparting a neat appearance to the case.

Next, a one-push opening operation according to this embodiment will be described.

First, when the lid portion 12 is in the state closed on the body portion 11 (the state shown in FIGS. 14 and 16), the male hook 8 of the body portion 11 and the female hook 9 of the lid portion 12 are engaged with each other, and the pushing operation section 5 exhibits the same configuration as the hinge 3.

In this condition, the case is held with one hand, with the thumb being applied from below to that side of the case where the male hook 8 is situated and the index and middle fingers being applied to that side where the pushing operation section 5 is situated, whereby the case is held between these fingers. Then, a pushing force is applied from both sides toward the interior of the case, whereby the male hook is pushed inwards so as to release the female hook 9 of the lid portion 12 from the engagement. When the pushing operation section 5 is further pushed in, the pushing operation section 5 is deformed so as to be bent at the bending grooves 7 formed therein. As a result of this deformation, the distance between that end portion 6 of the pushing operation section 5 which is on the body portion 11 and that end portion 6 thereof which is on the lid portion 12 increases. Then, that end portion 6 which is on the lid portion 12 moves upwards (as seen in the drawing). Actually, these movements are effected as a single (one push) operation.

Figure 17:
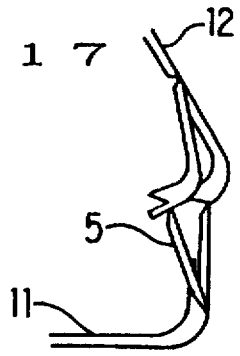
FIG. 17 is an enlarged sectional view showing the hinge portion opening mechanism of the case shown in FIG. 16.
Figure 18:
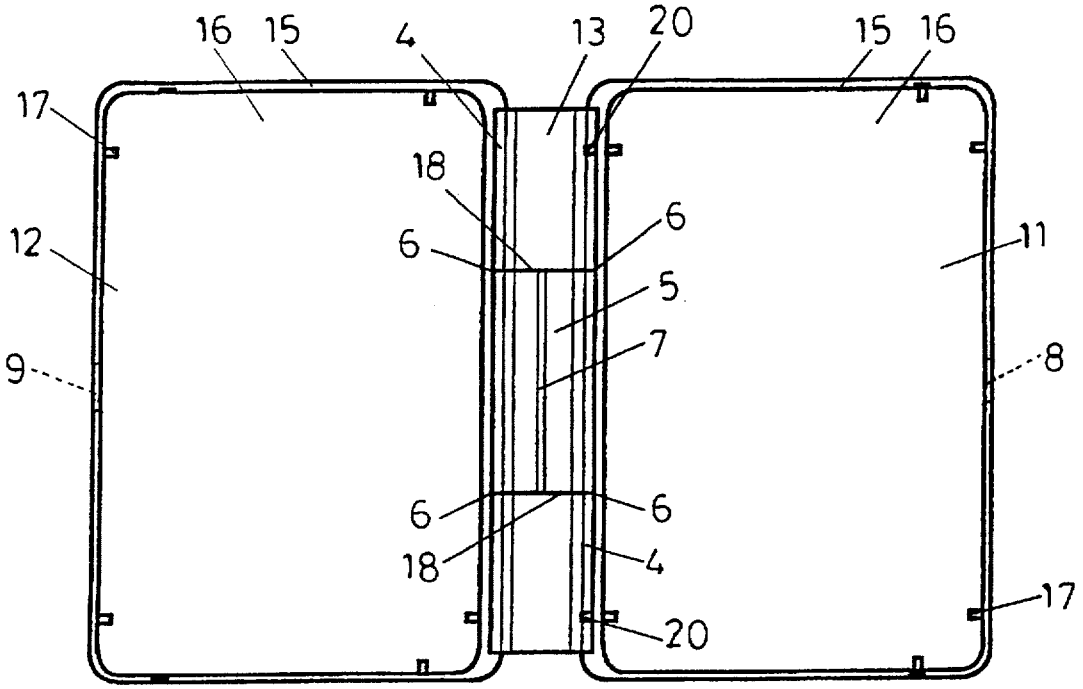
FIG. 18 is a plan view of another embodiment of the present invention which is applied to a cassette tape case capable of accommodating two cassettes, showing the case in a condition opened by 180°.
Figure 19:
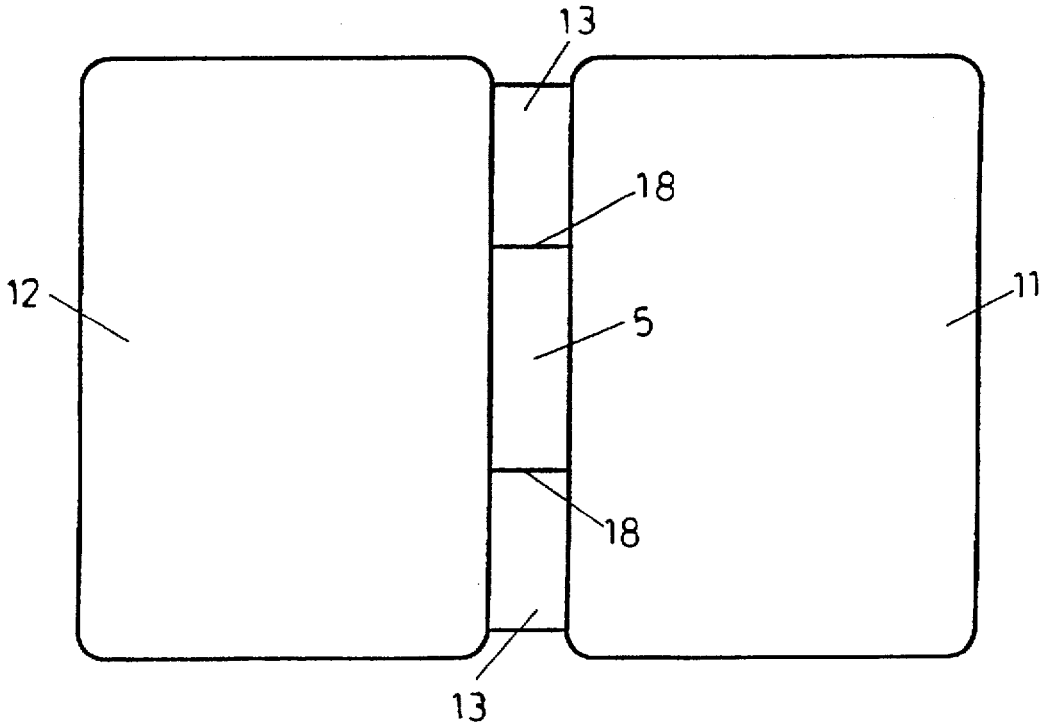
FIG. 19 is a bottom view of the case opened by 180°.
Figure 20:
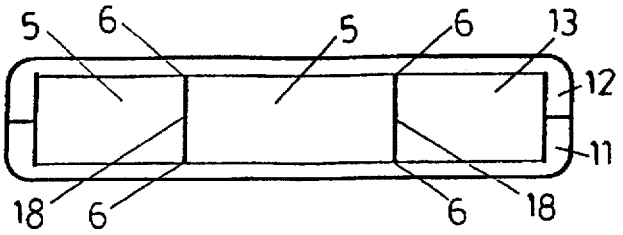
FIG. 20 is a front view of the case.
Figure 21:
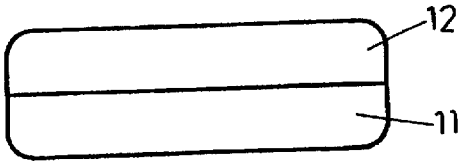
FIG. 21 is a side view of the case.

When that end portion 6 of the pushing operation section 5 which is on the lid portion 12 moves upwards (as seen in the drawing), the lid portion 12 itself also rotates on the hinge section 13, so that the lid portion 12 is also opened as shown in FIG. 17. By adjusting the amount by which the pushing operation section 5 is pushed in, it is possible to adjust the opening angle of the lid 12.

Figure 14:
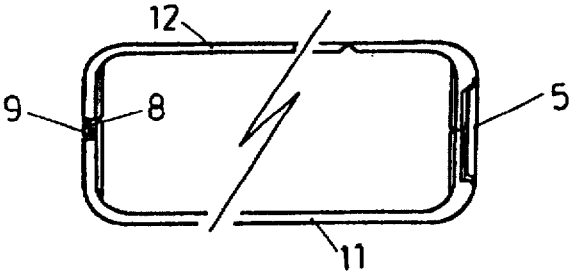
FIG. 14 is an enlarged sectional view of the opening mechanism portion of the case.

When the case is molded from a soft plastic material, there is no need to positively push the male hook 8 on the body portion 11 inwardly. In this case, when the pushing operation section 5 is pushed in, the lid portion 12 is slightly moved to the left (as seen in FIG. 14), whereby the engagement of the female hook 9 on the lid portion 12 and the male hook 8 on the body portion 11 is automatically cancelled. Thus, in this case, the lid portion 12 can be opened solely by pushing in the pushing operation section 5. In any case, the lid of the case, being held with one hand, can be opened through one-push operation by pushing in the pushing operation section 5, etc.

By forming the two slits 18 in such a way that their end portions 6 reach the lid portion 12 and the body portion 11, either the lid portion 12 or the body portion 11 can be opened by pushing whichever of the lid-side and body-side parts of the pushing operation section 5.

Third Embodiment

A lid opening mechanism will be described with reference to the integrally molded cassette tape case capable of accommodating two cassettes that is shown in FIGS. 18 through 23. As in the second embodiment, the mechanism is applicable to cases or containers for accommodating various objects.

The body of the cassette tape case capable of accommodating two cassettes is formed in one piece of plastic so as to be composed of thin cases 11 and 12 which are connected in such a way as to be rotatable on a hinge section 13. Numeral 14 indicates accommodating sections of the thin cases 11 and 12. Each accommodating section 14 is formed of an outer peripheral section 15 and a bottom section 16. The accommodating sections 14 have substantially the same configuration as the cassettes, and the outer peripheral sections 15 have substantially the same height (thickness) as the cassette tapes. Numeral 17 indicates cassette tape locking sections that are arranged in the outer peripheral sections 15 in such a way as to be engaged with the side surfaces of the cassette tapes. In the following description, the thin case 11 will be referred to as the body portion 11 and the thin case 12 as the lid portion 12.

Provided in the inner side of the case are hinge grooves 4 that are respectively formed in those portions of the hinge section 13 where it is hinged to the body portion 11 and the lid portion 12. When the body portion 11 and the lid portion 12 are respectively rotated so as to be bent by 90° at the hinge grooves 4, a box-like space is obtained which is surrounded by the respective bottom sections 16 and peripheral sections 15 of the body portion 11 and the lid portion 12 and the hinge section 13.

Numeral 5 indicates a pushing operation section, which is formed by providing two slits 18 in the central portion of the hinge section 13. The two slits 18, which extend along the opening/closing dimension of the lid 12, are spaced apart from each other so as to define a section therebetween which is large enough to be pushed by a finger, one end 6 of each slit 18 reaching the lid portion 12. In the example shown, the other end 6 of each slit 18 reaches the hinge groove 4 on the body portion 11 side. However, it is not always necessary for this end to reach the hinge groove 4. Numeral 7 indicates a bending groove 7 formed on that side of the pushing operating section 5 which on the inner side of the case. Due to the provision of the bending groove 7, the pushing operation section 5 can be deformed when pushed toward the interior of the case with a finger. While in the example shown only one bending groove 7 is provided, it is also possible to form a plurality of such grooves. When the pushing operation section 5 is sufficiently thin, such deformation is possible without having to form the bending groove 7.

Numeral 8 indicates a male hook formed on the body portion 11, and numeral 9 indicates a female hook formed on the lid portion 12. The male and female hooks 8 and 9 are engaged with each other when the lid portion 12 is closed. The male and female hooks 8 and 9 are also formed by one piece molding. Further, when, as shown in the drawings, both the male and female hooks 8 and 9 are formed inside the outer peripheral sections 15 of the case, no portion of the hooks protrudes beyond the contour of the case, thereby imparting a neat appearance to the case. Numeral 20 indicates a stopper which prevents the hinge section 13 from rotating so as to prevent the hinge 13 from falling on the body portion 11 when the case is opened, that is, the hinge section 13 is enabled to remain stationary with respect to the pushing operation section 5.

Next, the lid opening/closing operation of this embodiment will be described.

First, when the lid portion 12 is in the state closed on the body portion 11 (the state shown in FIG. 22), the male hook 8 of the body portion 11 and the female hook 9 of the lid portion 12 are engaged with each other, and the pushing operation section 5 exhibits the same shape as the hinge 3.

Figure 23:
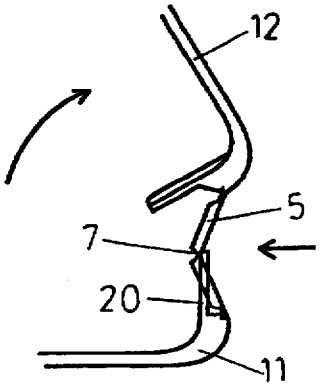
FIG. 23 is an enlarged sectional view showing the hinge portion opening mechanism.

In this state, the case is held with one hand, with the thumb being applied from below to the male hook 8 of the body portion 11 and the index and middle fingers to the pushing operation section 5, whereby the case is held between these fingers. Then, a pushing force is applied from both sides of the case to the inner side thereof, whereby the male hook 8 is pushed inwardly, thereby cancelling its engagement with the female hook 9 of the lid portion 12 to bring the lid portion 12 to a free state. When, as shown in FIG. 23, the pushing operation section 5 is further pushed in, the pushing operation section 5 is bent at the bending groove 7 formed therein and is deformed toward the interior of the case. This causes the angle made by the pushing operation section 5 and the lid portion 12 to decrease, with the result that the lid portion 12, which is under a bias toward restoring the former angle, opens in the direction indicated by the arrow. Actually, these movements are effected as a single (one push) operation, i.e., simultaneously.

In the above description, the thin case 11 is referred to as the body portion 11 for the sake of convenience. Relatively speaking, however, the hinge section 13 is also stationary with respect to the lid portion 12 (the thin case 12), that is, the hinge section 13 substantially constitutes a part of the body portion.

Figure 24:
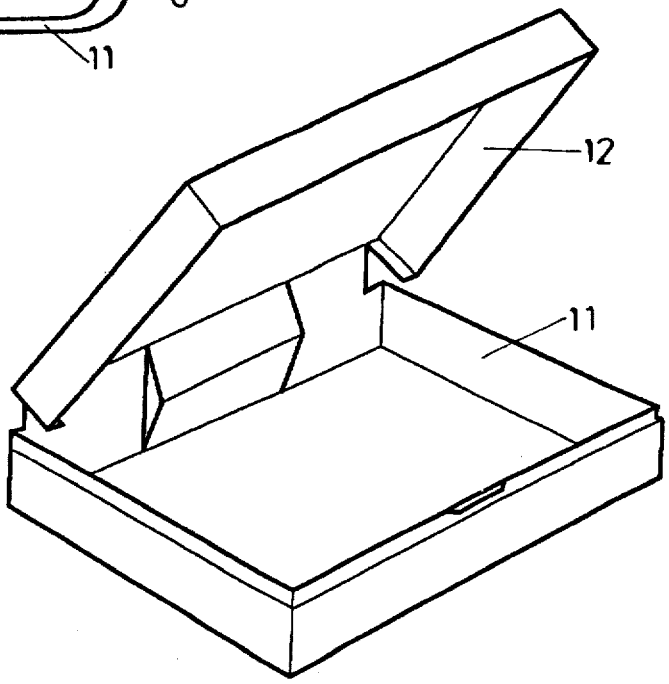
FIG. 24 is a perspective view of the embodiment as applied to a video cassette case.

When, as in the video tape case shown in FIG. 24, the body portion 11 and the hinge section 13 are held stationary, only the lid portion 12 is opened, so that the stopper 20 becomes unnecessary.

Fourth Embodiment

Figure 25:
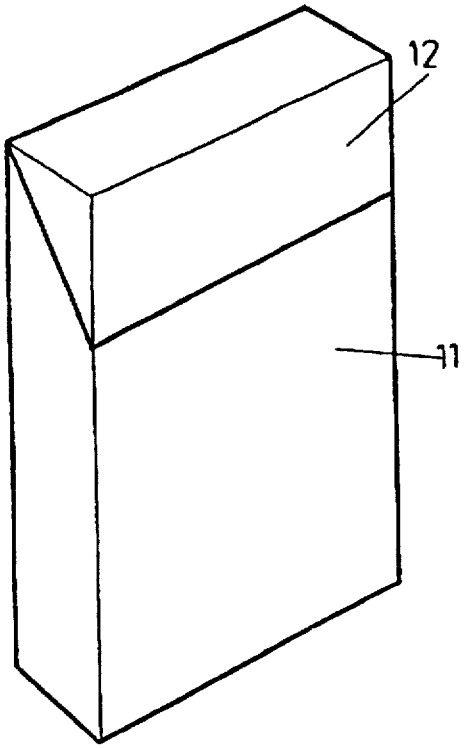
FIG. 25 is a front perspective view of a cigarette case to which an embodiment of the lid opening mechanism of the present invention is applied.
Figure 27:
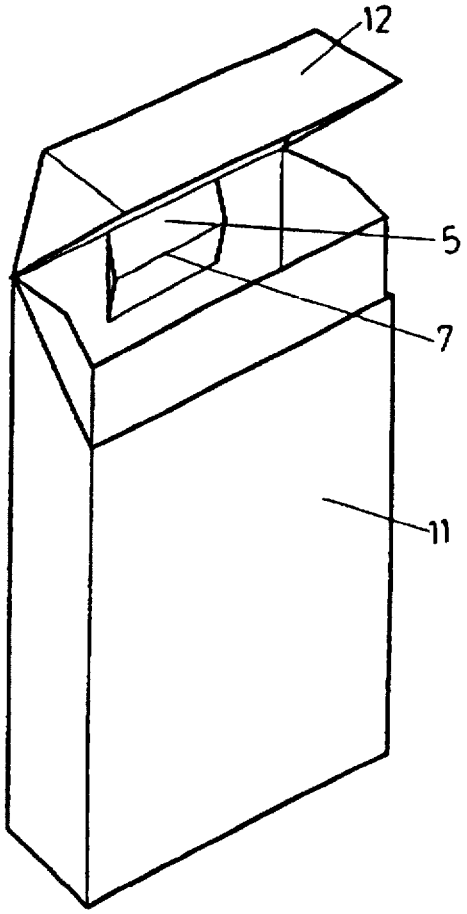
FIG. 27 is a front perspective view of the case with its lid portion open.
Figure 26:
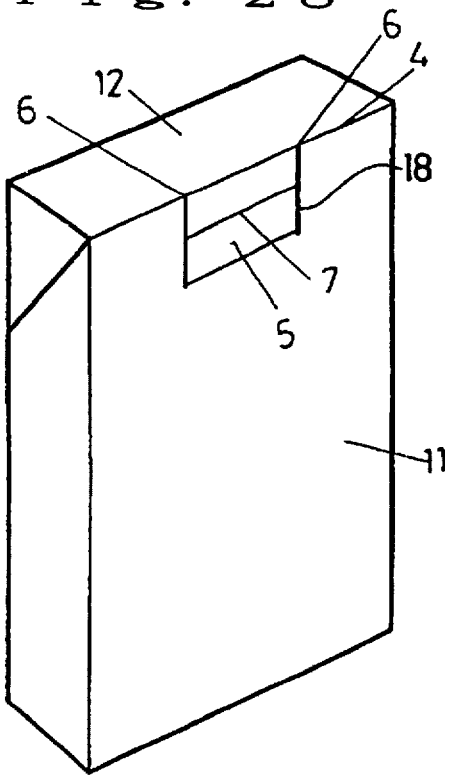
FIG. 26 is a rear perspective view of the case.
Figure 28:
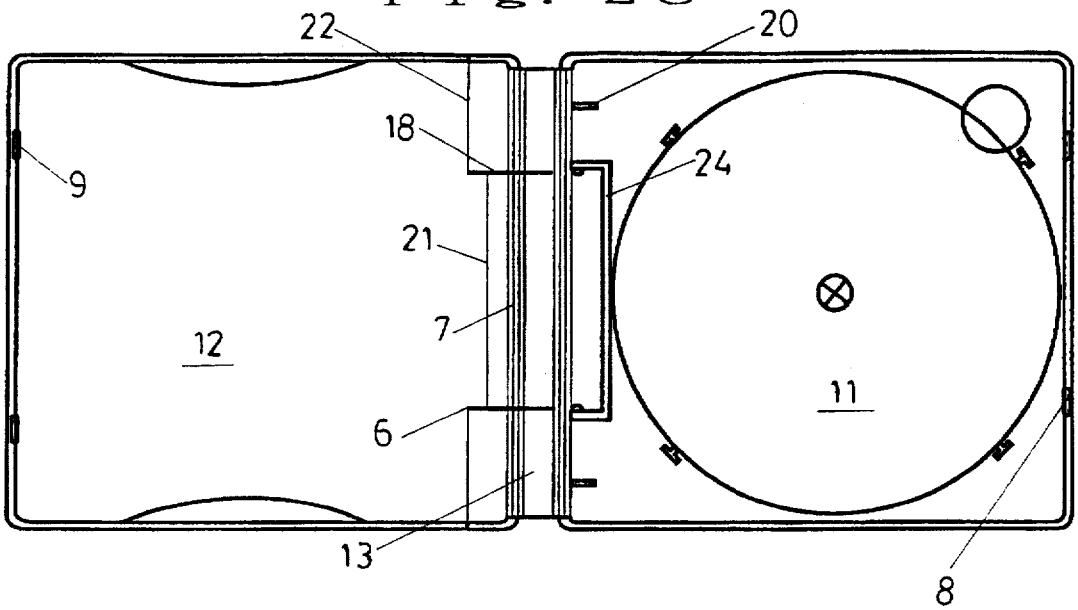
FIG. 28 is a plan view of a compact disc case to which the lid opening mechanism of the present invention is applied, the case being shown in a state opened by 180°.
Figure 29:
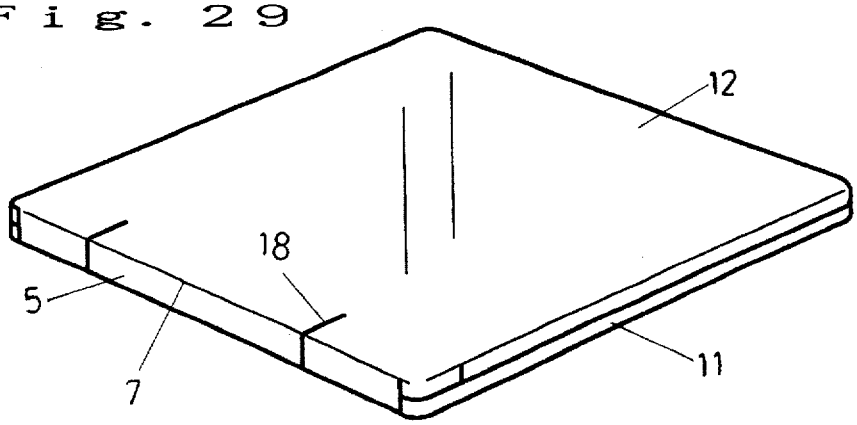
FIG. 29 is a perspective view of the case of FIG. 28 in the closed state.
Figure 30:
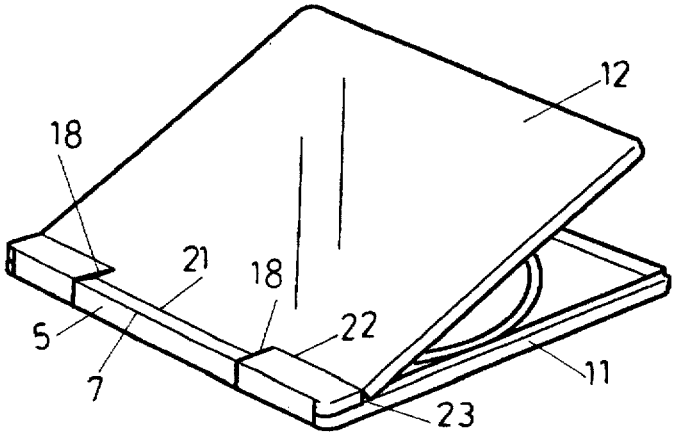
FIG. 30 is a perspective view of the case with its lid open.

Next, like the above third embodiment, a lid opening mechanism of the present invention will be described with reference to a paper cigarette case shown in FIGS. 25 through 27. The objects to be accommodated are not limited to cigarettes. The case can also be used in packing caramels, chocolates, etc., some of which have been sold in such paper cases.

The body of the cigarette case is formed through paper work as a box composed of a body portion 11 and a lid portion 12, which are rotatably connected together by a hinge line (hinge groove). This box can be formed by a well-known process.

Provided in that section of the body portion 11 which is above the hinge line (hinge groove) 4 is a pushing operation section 5, which is formed by two slits 18 spaced apart from each other so as to define a section therebetween which is large enough to be pushed with a finger, one end of each slit 18 being just long enough to reach the hinge groove 4. The slits 18 of the pushing operation section 5 may be formed in the pattern cut-out stage prior to the assembly of the case, or simultaneously with or posterior to the assembly of the case.

Numeral 7 indicates a bending groove formed in the pushing operation section 5. The bending groove 7 is provided for the purpose of enabling the pushing operation section 5 to be easily bent inwards there. It may simply consist of a bending line. Further, an appropriate number of bending grooves 7 may be formed. It is not absolutely necessary to provide the bending grooves 7 if the pushing operation section 5 can be deformed without them.

Further, to prevent deformation of the body portion 11, an appropriate reinforcement plate may be provided inside the body portion 11. While the case of this embodiment has been described on the assumption that it is formed through paper work, it is also possible for the case to be partly or entirely formed of plastic, metal, etc. Further, it is not always necessary for the case to be made of continuous paper. The body portion 11, the lid portion 12, the pushing operation section 5, etc. may be separately formed and then assembled by an appropriate process like adhesion.

To open the lid portion 12 of this embodiment, the pushing operation section 5 is pushed by an appropriate finger, including the thumb, index finger and middle finger, with the body portion being held by the hand 11, with the body portion 11 being held with one hand. To prevent dust or moisture from intruding the case through the slits 18, the interior or exterior of the case may be covered over an area extending from the body portion 11 to the pushing operation section 5 with a moisture-proof paper, plastic film or the like.

In the above embodiment, it is also possible to prepare the body portion 11 and the lid portion 12 separately and rotatably connect them together by a hinge. This arrangement makes it possible to employ different materials for the body and the lid and, at the same time, provide the hinge with any requisite reinforcement, etc.

Fifth Embodiment

Next, the lid opening mechanism will be described with reference to the integrally molded compact disc case shown in FIGS. 28 through 35.

Numeral 10 indicates a compact disc case body formed in one piece of plastic so as to be composed of a body portion 11 and a lid portion 12 which are connected together in such a way as to be rotatable on a hinge section 13. The body portion 11 includes an accommodating section 14 defined by outer peripheral sections 15 and bottom sections 16.

Formed on the inside of the case are hinge grooves 4 which are respectively formed in those portions of the hinge section 13 where it is joined to the body portion 11 and the lid portion 12. When the body portion 11 and the lid portion 12 are rotated so as to be bent by 90° at the hinge grooves 4, a box-like space results, which is surrounded by the respective bottom sections 16 and outer peripheral sections 15 of the body portion 11 and the lid portion 12 and the hinge section 13.

Numeral 5 indicates a pushing operation section formed in the central portion of the hinge section 13. The pushing operation section 5 is formed by two slits 18 spaced apart from each other so as to define therebetween a section large enough to be pushed with a finger. The slits 18 extend across the hinge grooves 4 of the hinge section 13, with one end 6 of each slit 18 reaching an arbitrary position on the lid portion 12 and the other end 6 thereof reaching the hinge groove 4 in the body portion 11. Since the pushing operation section 5 is formed by dividing the hinge section 13 by the slits 18, the pushing operation section 5 has bending grooves 7 which are similar to the hinge grooves 4 and situated at positions corresponding thereto.

Numeral 21 indicates a bending line formed in that part of the pushing operation section 5 which is on the lid portion 12. The bending line 21 is formed as a groove on the inner side of the lid portion 12. It is also possible for the bending line 21 to be formed on the outer side of the lid portion 12. Numeral 22 indicates bending sections formed respectively in the right and left end portions of the lid portion 12 so as to extend from those ends 6 of the slits 18 which are on the lid portion 12. Cuts 23 are formed in those sections of the side surfaces of the lid portion 12 which are connected to the bending sections 22.

Formed in those sections of the body portion 11 where the hinge section 13 abuts are stoppers 20 for preventing the hinge section 13 from falling on the body portion 11 when the lid is opened. Further, the stoppers 20 have the same height as the hinge section 13, and are adapted to abut against the back surface of the lid portion 12.

Numeral 24 indicates a support section serving as a fulcrum and provided in the body portion 11. That section of the pushing operation section 5 of the lid portion 12 which corresponds to the section between the bending line 21 and the bending sections 22 abuts against this support section. Numeral 25 indicates small protrusions for maintaining the lid portion 12 in the open state by engaging with the side surfaces of the hinge section 13.

When this case, having the lid opening mechanism of this embodiment, is formed in one piece, the bending groove 7, the bending line 21, and the bending section 22 are formed beforehand in the developed state before forming the container form by folding.

Next, the lid opening mechanism of this embodiment will be described.

Figure 31:
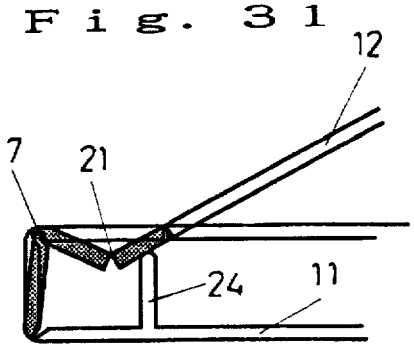
FIG. 31 is an enlarged perspective view showing the case of FIG. 30 in the open state.

When the lid portion 12 is laid in a flat position and the lid opening operation is performed from above, that part of the pushing operation section 5 which is on the lid portion 12 is pushed as shown in FIG. 31. This causes that part of the pushing operation section 5 on the side of the bending line 7 to be lowered by being bent at the bending line 21, using the support section 24 as the fulcrum, so that the lid 12 is opened in the manner shown in FIG. 32.

Figure 32:
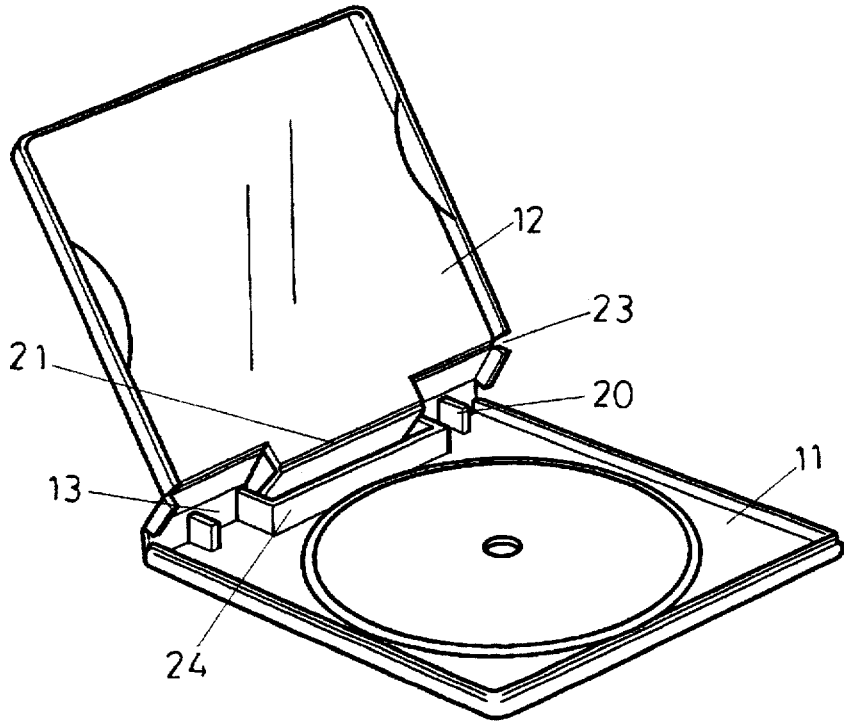
FIG. 32 is a perspective view of the case with its lid wide open.
Figure 33:
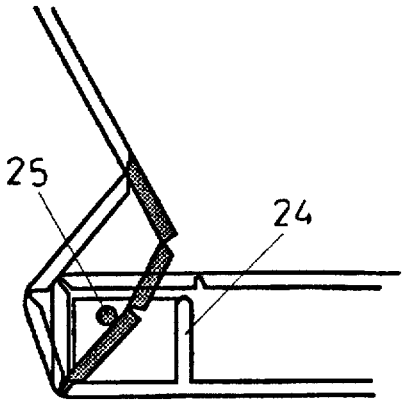
FIG. 33 is an enlarged sectional view showing the case of FIG. 32 in the open state.
Figure 34:
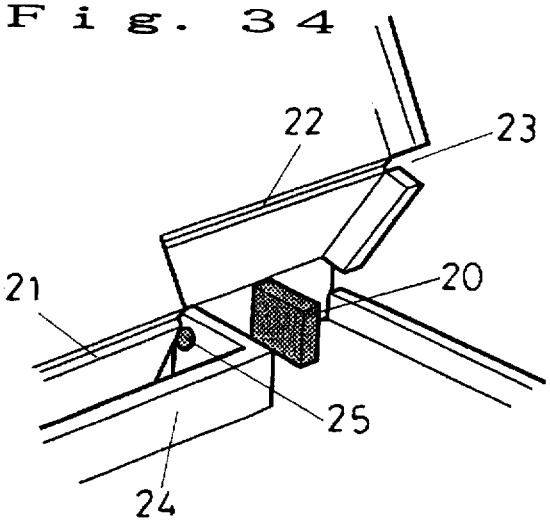
FIG. 34 is an enlarged sectional view showing the case of FIG. 32 in the open state.
Figure 35:
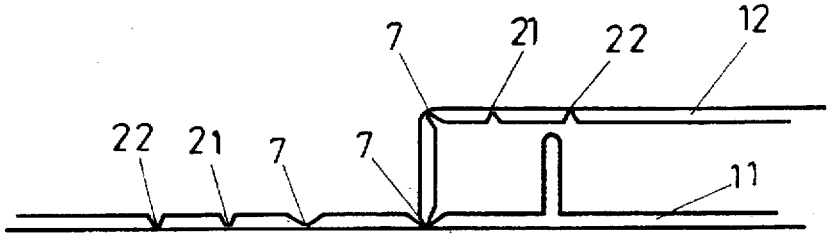
FIG. 35 is a side view showing a process for manufacturing the case shown in FIG. 28.

When the lid portion 12 is to be opened wide, that part of the pushing operation section 5 which is on the side of the hinge section 13 is pushed as shown in FIG. 33, whereby the pushing operation section 5 is bent inwardly at the bending line 21. This causes the lid portion 12 to be bent at the bending sections 22, and opened as shown in FIG. 32. When the lid portion 12 is to be maintained in the open state, the pushing operation section 5 is pushed in to such a large degree that those side surfaces of the pushing operation section 5 which are on the hinge 13 side are engaged with the protrusions 25 and thereby locked.

Thus, in this embodiment, the lid portion 12 can be opened to a large or small degree according to the part of the pushing operation section 5 which is pushed. When the lid is to be opened to a small degree, the case need not be held by the hand; it may remain placed in a flat position throughout the opening process. It is also possible for the case to be maintained in the wide-open state.

This embodiment is also applicable to the cover of the CD accommodating section of a CD player, the lid of a cosmetic compact case, etc.

Figure 36:
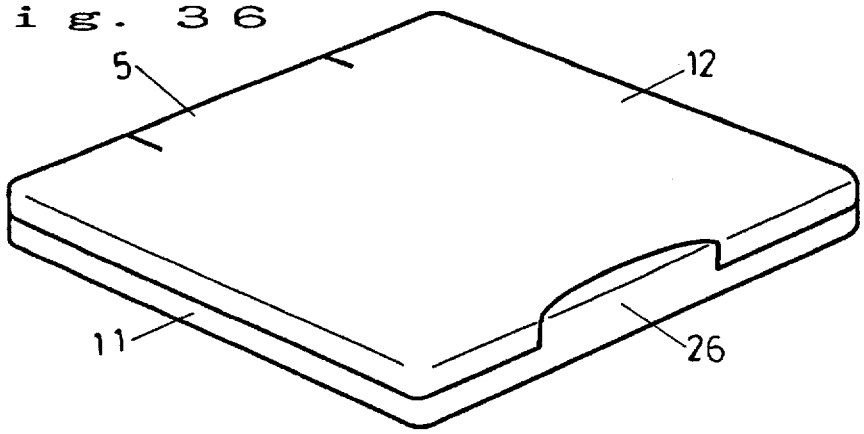
FIG. 36 is a perspective view of an embodiment in which that portion of the body which is opposed to the pushing operation section is formed to be relatively large so as to constitute a support section for enabling the case to be easily held between fingers.
Figure 37:
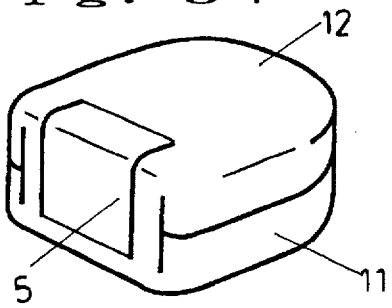
Figure 38:
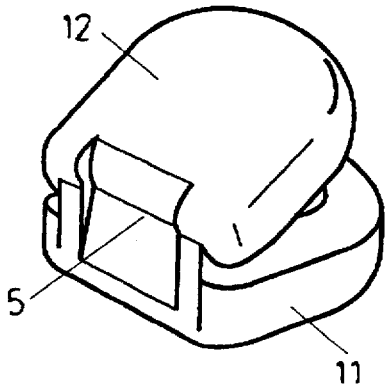
FIG. 38 is a perspective view of the cap with its lid open.
Figure 39:
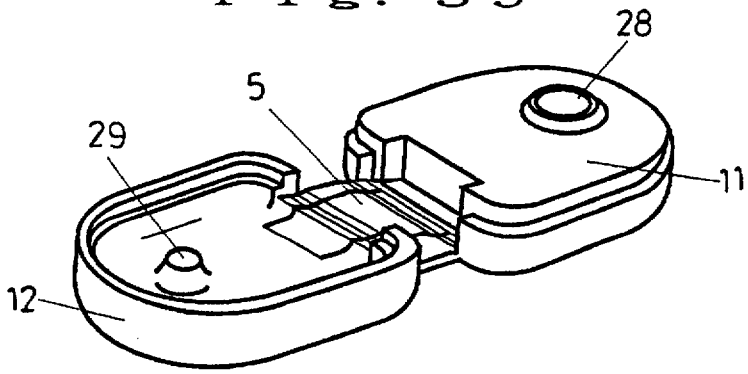
FIG. 39 is a perspective view of the cap with its lid completely open.
Figure 40:
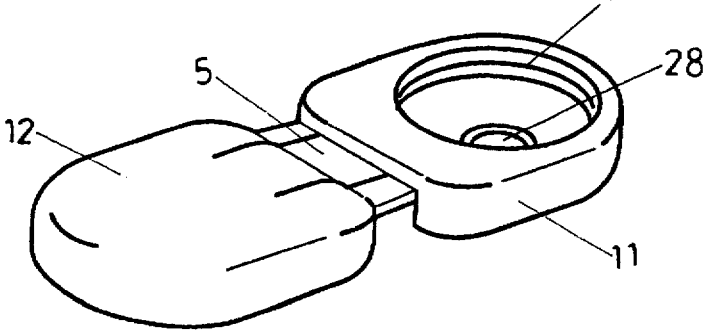
FIG. 40 is a perspective view, as seen from below, of the cap with its lid completely open.
Figure 41:
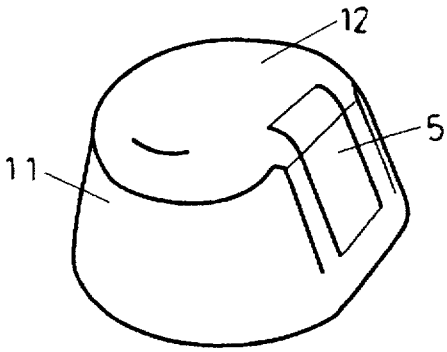
FIG. 41 is a perspective view showing another example of the cap.
Figure 42:
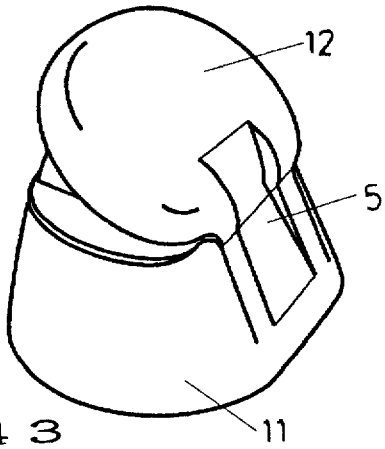
FIG. 42 is a rear perspective view of the cap with its lid open.
Figure 43:
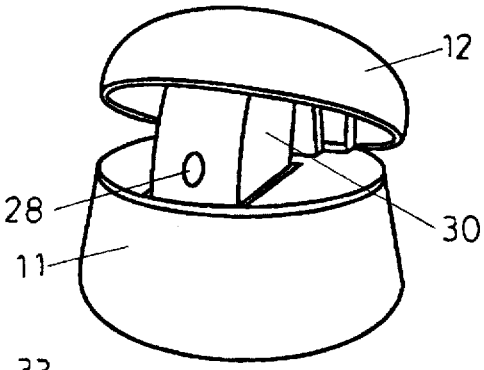
FIG. 43 is a front perspective view of the cap with its lid open.
Figure 44:
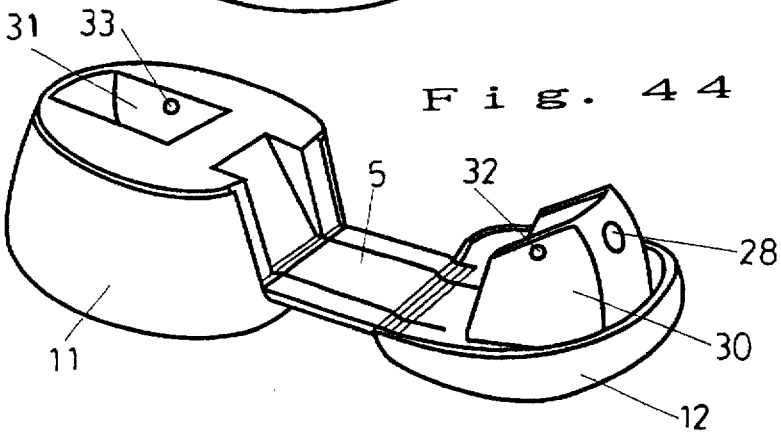
FIG. 44 is a perspective view, as seen from above, of the cap with its lid completely open.
Figure 45:
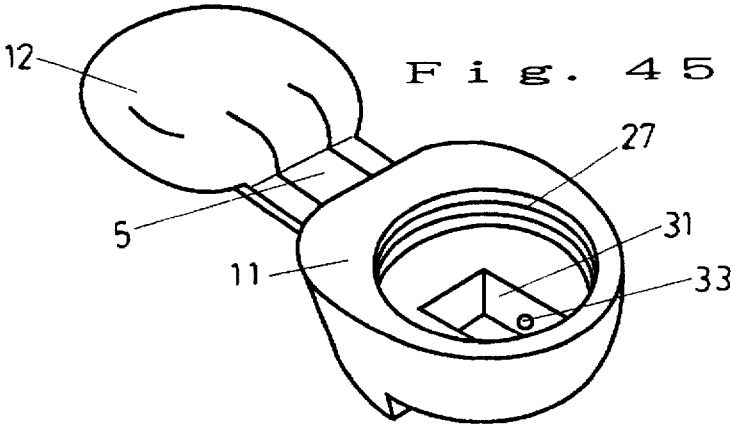
FIG. 45 is a perspective view, as seen from below, of the cap with its lid completely open.

To enable such a thin case to be easily held between fingers, that part of the body portion 11 which is opposite to the pushing operation section 5 may be enlarged so as to constitute a support section 26, as shown in FIG. 36. This arrangement makes it possible for only the body portion 11 to be stationary when the pushing operation section 5 is pushed from its sides, so that the fingers on both sides of the case do not stand in the way when the lid portion 12 is opened. This also applies to the lid opening mechanisms according to the other claims.

Sixth Embodiment

FIGS. 37 through 45 show an example of the lid opening mechanism of the present invention applied to the cap of bottles for shampoo or the like, or the cap of various containers for foods, condiments, etc. Numeral 27 indicates a thread groove to be engaged with the threaded portion at the top of the associated bottle. Numeral 28 indicates a discharge hole formed in the body portion 11, and numeral 29 indicates a tap for stopping the discharge hole 28.

The cap of this embodiment may be formed in one piece, or consist of an assembly of a body and lid which are separately formed.

Seventh Embodiment

Figure 46:
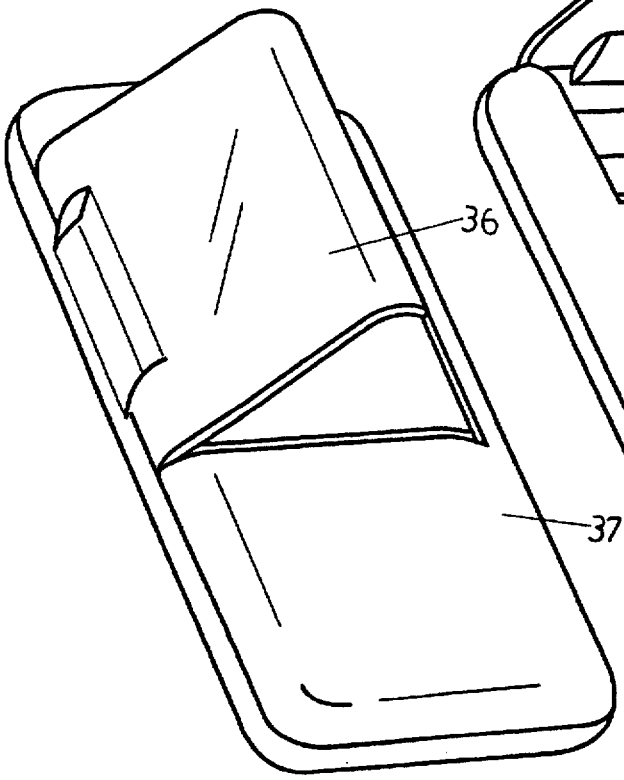
FIG. 46 is a perspective view of a remote control unit having a switch operating section to the cover of which the lid opening mechanism of the present invention is applied, showing the unit with its cover open.
Figure 47:
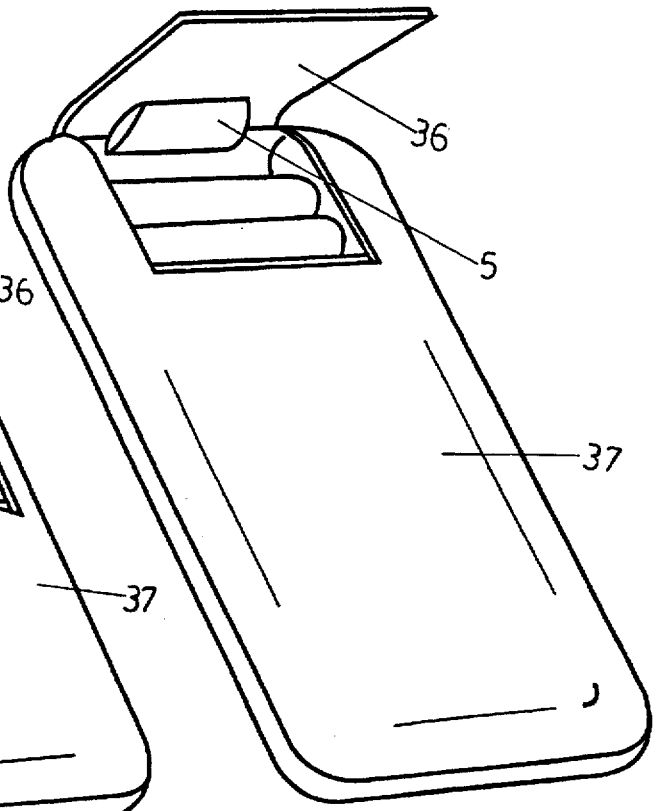
FIG. 47 is a perspective view of a remote control unit having a battery lodging section to the cover of which the lid opening mechanism of the present invention is applied, showing the unit with its cover open.

FIGS. 46 and 47 show examples of the lid opening mechanism of the present invention applied to apparatuses. The pushing operation section 5 is formed on an opening member 36, which is mounted on a stationary section 37, whereby it is possible for the opening member 36 to be opened by pushing the pushing operation section 5. The opening member 36 corresponds to the lid, and the stationary section 37 corresponds to the body. Examples of the apparatuses include various machines and appliances for home, office or industrial uses. For example, the mechanism is applicable to the cover of the switch operating section of a remote control for a household electric apparatus as shown in FIG. 46 or to the cover of the battery accommodating section of such a remote control as shown in FIG. 47. Further, it is also applicable to the cover of the power inlet, chord accommodating section and battery accommodating section of various electric apparatuses, or to the cover of the switch operating section of a telephone or a remote control. Further, the opening mechanism is applicable to relatively large structures, for example, the cover of automobile glove boxes or console boxes, the cover of household electric apparatus, or the doors of various articles of furniture, gates, house doors, automobile doors, etc.

Eighth Embodiment

Figure 48:
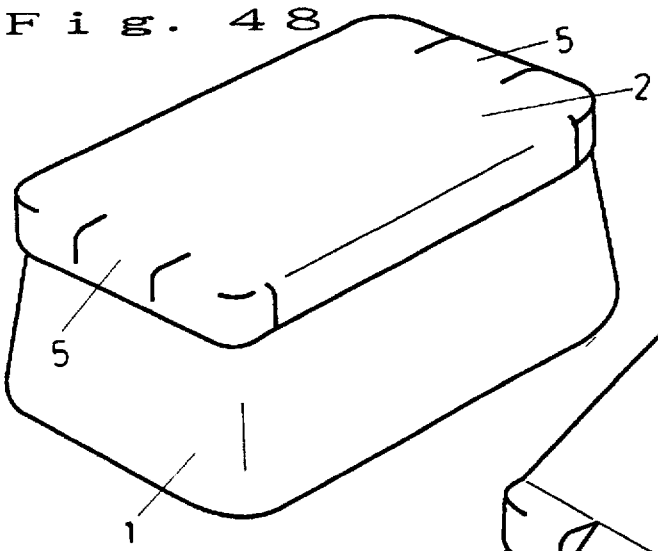
FIG. 48 is a perspective view of a toy box on the right and left sides of which the lid opening mechanism of the present invention is provided.
Figure 49:
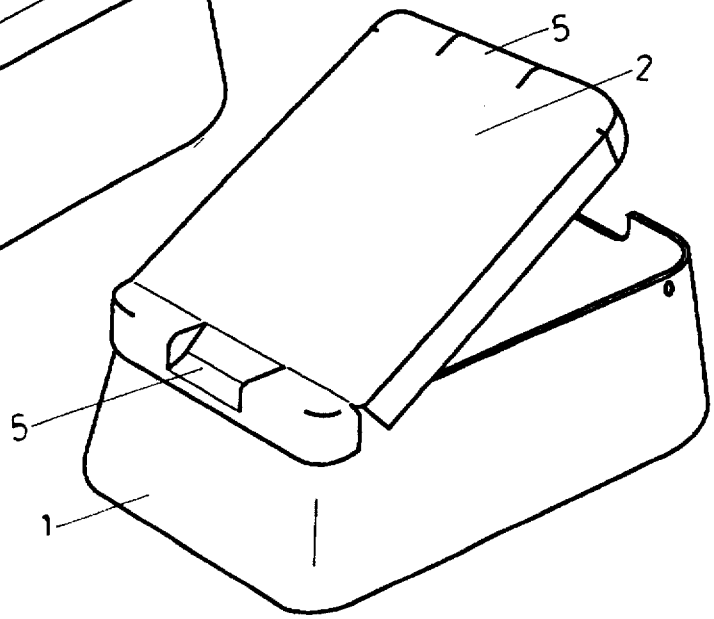
FIG. 49 is a perspective view of the box with its lid open.

FIGS. 48 and 49 show an example of the lid opening mechanism according to claim 3 as applied to a toy box having such a mechanism on the right and left sides of a lid 2. Pushing operation sections 5 are provided to the right and left of the lid 2, making it possible to open the lid 2 by pushing whichever of the pushing operation sections 5.

Further, when two sets of lid opening mechanisms according to claim 2 are arranged opposite to each other, it is possible for the lid to be opened like a French window, thereby increasing the opening area.

The bending grooves 7, bending line 21 and bending sections 22, provided in the above-described embodiments, have substantially the same function; it is only necessary for them to be bendable. They may be formed as grooves, or processed beforehand so as to be easily bent. As to the slits 18, slit-like cuts formed in accordance with the purpose and use will suffice from the functional viewpoint. In some cases, however, relatively wide slits may be formed.

When forming the case in one piece of plastic, the body portion 11, lid portion 12, hinge portion 13, pushing operation section 5, bending groove 7, bending line 21, bending sections 22, male hook 8, female hook 9, etc. are generally formed in a 180°-developed state. In this case, the case can be formed by a usual mold and molding technique. Further, by employing an elastic and soft material like PP, the durability of the hinge section 13, the pushing operation section 5, etc. can be enhanced, so that the molding is possible even in the case of extremely thin appliances, containers, etc.

Examples of the manufacturing process that can be adopted include molding processes, such as injection molding and blow molding, or sheet material processing, such as punching or stamping.

The sheet materials or the hooks for paper cases can be shaped into a case by ultrasonic adhesion, welding, fusion, fitting, paper fitting, etc. Further, it is also possible to separately manufacture the opening mechanism as a component to be mounted afterwards.

INDUSTRIAL APPLICABILITY

As described above, in the lid opening mechanism of the present invention, it is possible for the lid of a case being held with one hand to be opened with one push to a desired degree. Further, no special attention is required in opening the lid, so that the lid can be easily operated by people of all ages and box sexes.

It is also possible for the lid or cover of a case, appliance or the like which is not being held by the hand to be opened by pushing with a finger, etc. while being allowed to remain in a flat position or stationary.

When the lid opening mechanism of this invention is applied to a case formed in one piece, the section thereof serving as the pushing operation section can also be formed by one piece molding, so that an increase in the number of production processes can be avoided; further, no additional parts are required. Thus, it is possible for the mechanism to be produced at a considerably low cost and applied to various types of cases.

Further, by appropriately adjusting the length of the bending grooves, bending line, bending sections, etc. or the length of the slits or appropriately selecting the material, it is possible for the lid opening angle, opening method, etc. to be selected at will, thereby enabling the mechanism to be applied to a wide range of uses.

In addition, by separating the accommodating section of the container from the pushing operation section, it is possible to prevent intrusion of dust, moisture, etc. through the slits of the pushing operation section.

Instead of forming the lid opening mechanism of this invention in one piece with the associated container, etc., it may be prepared as a separate component which can be widely applied to various types of furniture, apparatus, containers, etc. Thus, the mechanism of the present invention has a very wide range of application and has great utility.

What is claimed is:

1. A lid opening mechanism system comprising a container having a body structure and a lid structure, a side section integral with said body structure and said lid structure and extending in a generally longitudinal direction, two spaced slits in said side section extending transversely of said longitudinal direction, the portion of the side section between said two spaced slits forming a push-in part, the width of said push-in part in said longitudinal direction being at least as great as the width of a person's finger, the parts of the side section on either side of said push-in part forming aligned lateral parts, said lateral parts including a flexible hinge which flexes as one of said structures is moved relative to the other of said structures from a closed position to an open position, said push-in part being operable to be pushed in by a person's finger to move said push-in part from a non-pushed-in position to a pushed-in position, said push-in part in being moved from said non-pushed-in position to said pushed-in position effecting movement of said one structure relative to said other structure about said flexible hinge from said closed position to said open position, said push-in part when in said non-pushed-in position being in general alignment with said lateral parts and having substantially the same configuration as said lateral parts to thereby form a continuation of said lateral parts.

2. A lid opening mechanism system according to claim 1 wherein said push-in part has an outer surface, each of said lateral parts having an outer surface, said outer surface of said push-in part and each of said outer surfaces of each of said lateral parts forming a single continuous surface when said push-in part is in said non-pushed-in position.

3. A lid opening mechanism system according to claim 2 wherein said single continuous surface is an arcuate surface.

4. A lid opening mechanism system according to claim 1 wherein said flexible hinge includes an elongated groove.

5. A lid opening mechanism system according to claim 1 wherein said push-in part includes an elongated groove.

6. A lid opening mechanism system according to claim 1 wherein said flexible hinge includes an elongated groove, said push-in part including an elongated groove aligned with said elongated groove on said flexible hinge.

7. A lid opening mechanism system according to claim 1 wherein an integral pivot joint groove is provided between said push-in part and said one structure.

8. A lid opening mechanism system according to claim 7 wherein an integral pivot joint groove is provided between said push-in part and said other structure.

9. A lid opening mechanism system according to claim 1 wherein said push-in part includes two sections, one of said sections having a generally L-shaped configuration.

10. A lid opening mechanism system according to claim 9 further comprising an integral pivot groove joint pivotably and integrally connecting said one push-in section to the other push-in section, an integral pivot groove joint pivotably and integrally connecting said one push-in section to said one structure and an integral pivot groove joint pivotably and integrally connecting the other push-in section to said other structure.

11. A lid opening mechanism system according to claim 10 wherein said one push-in section retains its L-shaped configuration when said push-in part is in said non-pushed-in position and when in said pushed-in position.

12. A lid opening mechanism system according to claim 1 wherein said push-in part includes two sections, an integral pivot groove joint pivotably and integrally connecting said two sections, said two sections being disposed in a generally V-shaped configuration when said push-in part is in said pushed-in position, said two sections being generally disposed in the same plane when said pushed-in part is in said non-pushed-in position.

13. A lid opening mechanism system according to claim 12 further comprising an integral pivot groove joint pivotably and integrally connecting one of said two sections to said one structure, and an integral pivot groove joint pivotably and integrally connecting the other of said two sections to said other structure.

14. A lid opening mechanism system according to claim 1 further comprising a first integral pivot groove joint pivotably and integrally connecting said push-in part to said one structure, a second integral pivot groove joint pivotably and integrally connecting said push-in part to said other structure, said push-in part having a first portion juxtaposed to said first integral pivot groove joint, said one structure having a second portion juxtaposed to said first integral pivot groove joint, said first and second portions being disposed in a generally V-shaped configuration when said push-in part is in said pushed-in position, said first and second portions being generally in the same plane when said push-in part is in said non-pushed-in position.

15. A lid opening mechanism system according to claim 14 wherein said second integral pivot joint pivotably and integrally connects said push-in part to a juxtaposed portion of said other structure, a third integral groove pivot joint pivotably and integrally connecting said juxtaposed portion of said other structure to said first portion of said push-in part, said juxtaposed portion and said first portion being disposed at right angles to one another when said push-in portion is in said non-pushed-in position.

16. A lid opening mechanism system according to claim 15 wherein said one structure has a flat top, said other structure having a flat bottom, said pushed-in portion and said hinge having integral pivot grooves enabling relative pivotal movement between said one structure and said other structure, said pushed-in portion, said hinge, said one structure and said other structure being relatively pivotal such that said push-in part, said hinge, said one structure and said other structure are all disposed in a common plane.

17. A lid opening mechanism system according to claim 1 further comprising a hook device having one hook part disposed on said one structure and another hook part disposed on said other structure, said one and said other hook parts being movable between a hooked position and a release position, said one hook part being moveable from said hooked position by pushing on one of said structures juxtaposed to one of said hook parts with one or more fingers of a person's hands while said pushed-in part is moved from said non-pushed in position to said pushed-in position by other fingers of the same hand of said person whereby said hook device is moved from its hooked position to its release position and said one structure is moved from said closed position to said open position by the fingers of one hand of said person.

18. A lid opening mechanism system according to claim 1 wherein said container is made of a plastic material.

19. A lid opening mechanism system according to claim 1 wherein said container is made of paper.

20. A lid opening mechanism system comprising a container having a body structure and a lid structure, a side section integral with said body structure and said lid structure and extending in a generally longitudinal direction, two spaced slits in said side section extending transversely of said longitudinal direction, the portion of the side section between said two spaced slits forming a push-in part, the width of said push-in part in said longitudinal direction being at least as great as the width of a person's finger, the parts of the side section on either side of said push-in part forming aligned lateral parts, said lateral parts including a flexible hinge which flexes as one of said structures is moved relative to the other of said structures from a closed position to an open position, said push-in part being operable to be pushed in by a person's finger to move said push-in part from a non-pushed-in position to a pushed-in position, said push-in part in being moved from said non-pushed-in position to said pushed-in position effecting movement of said one structure relative to said other structure about said flexible hinge from said closed position to said open position, a hook device having one hook part disposed on said one structure and another hook part disposed on said other structure, said one and said other hook parts being movable between a hooked position and a release position, said one hook part being movable from said hooked position by pushing on one of said structures juxtaposed to one of said hook parts with one or more fingers of a person's hands while said pushed-in part is moved from said non-pushed-in position to said pushed-in position by other fingers of the same hand of said person, whereby said hook device is moved from its hooked position to its release position and said one structure is moved from said closed position to said open position by the fingers of one hand of said person.

* * * * *